US007262380B1

(12) United States Patent
Ulrichsen et al.

(10) Patent No.: US 7,262,380 B1
(45) Date of Patent: Aug. 28, 2007

(54) DETERMINATION OF CHARACTERISTICS OF MATERIAL

(75) Inventors: Borre Bengt Ulrichsen, Oslo (NO); Clas Fredrik Mender, Oslo (NO); Geir Foss-Pedersen, Drammen (NO); Jon Henrik Tschudi, Oslo (NO); Ib-Rune Johansen, Oslo (NO)

(73) Assignee: Titech Visionsort AS, Oslo (NO)

( * ) Notice: Subject to any disclaimer, the term of this patent is extended or adjusted under 35 U.S.C. 154(b) by 0 days.

(21) Appl. No.: 09/541,718

(22) Filed: Apr. 3, 2000

Related U.S. Application Data

(62) Division of application No. 08/776,689, filed as application No. PCT/IB95/00672 on Aug. 2, 1995, now Pat. No. 6,060,677.

(30) Foreign Application Priority Data

Aug. 19, 1994 (GB) ..... 9416787.1
Feb. 22, 1995 (GB) ..... 9503472.4

(51) Int. Cl.
*B07C 5/00* (2006.01)

(52) U.S. Cl. ..... 209/577; 209/587; 209/639; 209/938; 250/223 R; 250/225

(58) Field of Classification Search ..... 209/576, 209/577, 580, 587, 588, 639, 936, 938; 250/223 R, 250/225, 391; 198/434, 443, 445, 448
See application file for complete search history.

(56) References Cited

U.S. PATENT DOCUMENTS 4,718,558 A * 1/1988 Castaneda ..... 209/587 X
4,909,930 A * 3/1990 Cole ..... 209/587 X
5,555,984 A * 9/1996 Sommer, Jr. et al. ... 209/581 X
6,060,677 A * 5/2000 Ulrichsen et al. ..... 209/938 X
6,068,106 A * 5/2000 Brizzi et al. ..... 198/448

FOREIGN PATENT DOCUMENTS

EP 484221 * 5/1992 ..... 209/587

* cited by examiner

*Primary Examiner*—Patrick Mackey
*Assistant Examiner*—Mark Hageman
(74) *Attorney, Agent, or Firm*—Calfee, Halter & Griswold, LLP

(57) ABSTRACT

A system for automatically inspecting matter for varying composition comprises one or more detection stations through which one or more streams of matter are advanced and particular materials therein are detected through their diffusely reflected IR spectra, if any, and/or through their variation of an electromagnetic field by their metallic portions, if any. A row of light sources distributed across the overall width of one or more belt conveyors may cause desired portions of the stream to reflect light diffusely onto a part-toroidal mirror extending over that overall width, whence the light is reflected, by a rotating, polygonal mirror through optical filters dedicated to differing IR wavelengths, onto detectors the data output of which is utilized in controlling solenoid valves operating air jet nozzles which separate-out the desired portions. Alternatively or additionally, an oscillator and an antenna which extends over that overall width generate an electromagnetic field through the belt and sensing coils sense variations therein produced by metallic portions of the stream passing through the detection station and the detection data produced by the sensing coils is used to control the solenoid valves operating the nozzles to separate-out the metallic portions.

27 Claims, 10 Drawing Sheets

DETERMINATION OF CHARACTERISTICS OF MATERIAL

CROSS-REFERENCES TO RELATED APPLICATIONS

This Application is a Divisional of our U.S. patent application Ser. No. 08/776,689 filed as International Patent Application Serial No. PCT/1B95/00672 on Aug. 2, 1995 and issued on 9 May 2000 as U.S. Pat. No. 6,060,677.

BACKGROUND OF THE INVENTION

1. Field of the Invention

This invention relates to determination in first and second dimensions of characteristics of material, for example automatic inspection and sorting of discrete objects of differing compositions, e.g. waste objects, or automatic inspection of sheet material, which may be in the form of a strip, for surface layer composition, e.g. surface layer thickness.

2. Description of the Related Art Including Information Disclosed under 37CFR 1.97 and 1.98

With the recent focus on collection and recycling of waste, the cost effectiveness of waste sorting has become an essential economic parameter.

In the "Dual System" in Germany all recyclable "non-biological" packaging waste excluding glass containers and newsprint is collected and sorted in more than 300 sorting plants.

Objects can be sorted on the basis of:

Size

Density/weight

Metal content (using eddy current effect)

Ferrous metal content (using magnetic separation)

but most objects such as plastics bottles and beverage cartons are today sorted out manually. Some beverage cartons contain an aluminium barrier and by eddy current induction they can be expelled from the waste stream. Generally, beverage cartons in their simpler form present a composite object consisting of paperboard with polymer overcoats on both their inside and outside surfaces.

To make a positive identification by automatic means is very difficult. Physical shape is normally quite distorted, making any camera-based recognition very complex unless the printing pattern is made in a specially recognisable way, or the carton is equipped with a recognisable marker or tracer.

Several sorting systems exist today that can sort a number of different plastics bottles/objects from each other when they arrive sequentially (i.e. one-by-one). The detection is based on reflected infrared spectrum analysis. To separate the various polymers a quite elaborate variance analysis has to be performed and thus detection systems become expensive. The objects being fed sequentially pass beneath the infrared spectral detector whereby infrared is shone onto the objects and the relative intensities of selected wavelengths of the infrared radiation reflected are used to determine the particular plastics compound of the plastics passing beneath the detection head. Downstream of the detection head are a number of air jets which blow the individual plastics objects into respective bins depending upon the plastics which constitutes the majority of the object.

A similar system is disclosed in U.S. Pat. No. 5,134,291 in which, although the objects to be sorted can be made of any material, e.g. metals, paper, plastics or any combination thereof, it is critical that at least some of the objects be made predominantly from PET (polyethylene terephthalate) and PS (polystyrene) as well as predominantly from at least two of PVC (polyvinyl chloride), PE (polyethylene) and PP (polypropylene), for example objects including: an object made predominantly from PET, an object made predominantly from PS, an object made predominantly from PVC and an object made predominantly from PE. A source of NIR (Near Infra Red), preferably a tungsten lamp, radiates NIR onto a conveyor sequentially advancing the objects, which reflect the NIR into a detector in the form of a scanning grating NIR spectrometer or a diode array NIR spectrometer. The detector is connected to a digital computer connected to a series of solenoid valves controlling a row of air-actuated pushers arranged along the conveyor opposite a row of transverse conveyors. The diffuse reflectance of the irradiated objects in the NIR region is measured to identify the particular plastics of each object and the appropriate solenoid valve and thus pusher are operated to direct that object laterally from the conveyor onto the appropriate transverse conveyor. The computer can manipulate data in the form of discrete wavelength measurements and in the form of spectra. A measurement at one wavelength can be ratioed to a measurement at another wavelength. Preferably, however, the data is manipulated in the form of spectra and the spectra manipulated, by analogue signal processing and digital pattern recognition, to make the differences more apparent and the resulting identification more reliable.

DE-A-4312915 discloses the separation of plastics, particularly of plastics waste, into separate types, on the basis of the fact that some types of plastics have characteristic IR spectra. In the IR spectroscopic procedure, the intensity of diffusely reflected radiation from each sample is measured on a discrete number of NIR wavelengths simultaneously and the intensities measured are compared. Measurements are taken on wavelengths at which the respective types of plastics produce the minimum intensities of reflected radiation. If, for example, three different plastics are to be separated, each sample is measured on three-wavelengths simultaneously, whereby one type of plastics is identified in a first comparison of the intensity of the reflected radiation on the lowest wavelength with that of the second-lowest wavelength and the other two types of plastic are determined in a second comparison of the greater intensity on one wavelength in the first comparison with the intensity on the third wavelength. To measure the light on particular wavelengths, respective detectors can have narrow band pass filters for the respective requisite wavelengths, and respective constituent cables of a split optical fibre cable are allocated to the respective detectors, the cable entry lying in the beam path of a lens for detecting the light reflected from the sample. Alternatively, a light dispersing element, e.g. a prism or grid, is placed in the beam path after the lens and several detectors are arranged to detect the NIR of the requisite wavelengths. Sorting facilities are controlled by utilising the detection data obtained by the comparisons. As a further example, five differing plastics, namely PA (polyamide), PE, PS, PP and PETP, may be separated, utilising measurement points at five differing wavelengths between 1500 nm. and 1800 nm.

EP-A-557738 discloses an automatic sorting method with substance-specific separation of differing plastics components, particularly from domestic and industrial waste. In the method, light is radiated onto the plastics components, or the plastics components are heated to above room temperature, light emitted by the plastics components and/or light allowed through them (in an embodiment in which light transmitted through the components and through a belt conveying them is measured) is received on selected IR wavelengths, and the material of the respective plastics components is identified from differences in intensity (contrast) between the light emitted and/or absorbed, measured on at least two differing wavelengths. The light emitted or allowed through is received by a camera which reproduces it on a detector through a lens. A one-dimensional line detector is usable, although a two-dimensional matrix detector or a one-element detector with a scanning facility can be employed. In order that the camera may receive the light on selected IR wavelengths, interference filters may be mounted either in front of the light source or in front of the lens or the detector. In an example in which the material of the plastics components is identified from the differences in intensity of emitted light at two differing wavelengths, the wavelengths are chosen to produce maximum contrast. This means that one wavelength is selected so that maximum intensity of the emitted light is obtained at a specified viewing angle, whereas the other wavelength is selected so that minimum intensity is obtained at that viewing angle. Changing of wavelengths may be achieved by mounting the filters on a rotating disc, with the frequency of rotation being synchronised with the imaging frequency of the detector. Alternatively, an electrically triggered, turnable, optical filter may be employed. The electrical signals generated by the detector are fed to an electronic signal processor, digitised, and subsequently evaluated by image processing software. It is ensured that the plastics components are at approximately the same temperature at the time of imaging, as differences in contrast can also be caused by temperature differences. The belt should consist of a material which guarantees constant contrast on individual wavelengths.

There is also previously known a system in which infrared spectral detection is performed from below the objects, with the objects passing sequentially over a hole up through which the IR is directed. Again, the infrared reflected is used to sort the objects according to the various plastics within the respective objects.

U.S. Pat. No. 5,260,576 and EP-A-484,221 disclose a method and apparatus for distinguishing and separating material items having different levels of absorption of penetrating electromagnetic radiation by utilising a source of radiation for irradiating an irradiation zone extending transversely of a feed path over which the material items are fed or passed. The irradiation zone includes a plurality of transversely spaced radiation detectors for receiving the radiation beams from the radiation source. The material items pass through the irradiation zone between the radiation source and the detectors and the detectors measure one or more of the transmitted beams in each item passing through the irradiation zone to produce processing signals which are analyzed by signal analyzers to produce signals for actuating a separator device in order to discharge the irradiated items toward different locations depending upon the level of radiation absorption in each of the items. The disclosure states that mixtures containing metals, plastic, textiles, paper and/or other such waste materials can be separated since penetrating electromagnetic radiation typically passes through the items of different materials to differing degrees, examples given being the separation of aluminum beverage cans from mixtures containing such cans and plastic containers and the separation of chlorinated plastics from a municipal solid waste mixture. The source of penetrating radiation may be an X-ray source, a microwave source, a radioactive substance which emits gamma rays, or a source of UV energy, IR energy or visible light. One example of material items which are disclosed as having been successfully separated are recyclable plastic containers, such as polyester containers and polyvinyl chloride (PVC) containers, which were separated using X-rays.

In an eddy current system for ejecting metal from a stream of waste, the discharge end roller of a belt conveyor normally contains a strong alternating magnetic field generated by permanent magnets contained within and distributed along the roller and counter-rotating relative to the sense of rotation of the roller. This field ejects metallic objects to varying degrees depending upon the amount and the conductivity of the metal of the object. Since metallic objects in which the metal content is small, for example post-consumer packaging cartons of a laminate consisting of polymer-coated paperboard and aluminium foil, are only weakly affected by the magnetic field, such cartons, if in a greatly deformed condition, tend not to be separated-out by the eddy-current ejection system.

Another known system uses an electromagnetic field for eddy current detection through induction of eddy currents in the metal in metallic objects and the detection output is used to control an air jet ejection arrangement but this time the objects are caused to queue up one after another in single lines.

U.S. Pat. No. 4,718,559 discloses selective non-magnetic detection of non-ferrous metallic particles in a mixture of the same with ferrous metallic particles and non-metallic particles and non-metallic particles derived from homogenised and magnetically treated municipal or like waste by a plurality of electronic detectors and separation of a non-ferrous metallic concentrate from the mixture. In the process, the waste particles, agglomerates or vicinity of detector coils in association with an electronic activation system which activates a particle remover, preferably pneumatic. The remover may be made up of an air supply line which conducts air to an air valve and jet-type spray unit which causes most of the non-ferrous metallic particles to fall into or onto a non-metallic residue conveyor, which is separated from a metallic concentrate conveyor by a partition.

Various systems are known for automatic inspection of a continuous strip of sheet material. One system includes a mechanical scanner reciprocated across the width of the strip as the latter advances past the scanner. Light containing IR is shone onto a transverse section of the strip and the scanner includes a transducer which detects the reflected IR at a plurality of locations across the section and emits electrical signals representing, for instance, the polymer layer thickness of a polymer layer/paperboard layer laminate. This is employed in a laminating machine to control the thickness of polymer deposited onto the paperboard.

U.S. Pat. No. 4,718,558 and U.S. Pat. No. 4,057,146 incorporated therein by reference disclose apparatus for optically sorting small lightweight objects such as beans and/or grains on the basis of size and colour. The small objects pass through the apparatus in a plurality of separate streams, each stream being fed from its own hopper to its own control gate to its own vibrating try and thence, through its own vertically positioned channel, to arrive at its own analysis head. Each analysis head is in the form of an annulus with the central opening directly beneath the outlet end of the corresponding channel and the small objects in the corresponding stream fall down through its central opening one after another with vertical separation therebetween. Illumination is supplied by a plurality of illuminating lamps. For each analysis head, the light reflected from it particular stream is conveyed to a plurality of photodetectors of that head. The reflected light is conveyed to that plurality of photodetectors by a plurality of optical fibres of the analysis head. A solenoid-operated compressed air valve is opened when an object in the stream is to be rejected into a rejection hopper; otherwise, the valve remains closed and the objects fall directly into an acceptance hopper. It appears that analysis circuits for the respective streams are housed in a common control unit having a control panel which displays information and allows an operator to control the apparatus, including the setting of parameters.

U.S. Pat. No. 4,996,440 discloses a system for measuring one or a plurality of regions of an object to be able to determine one or a plurality of dimensions of the object. In one example, the system utilises a mirror arrangement for transmitting pulsed laser light so that the light impinges downwards upon the object and for receiving the upwardly reflected light. The system includes a laser, a rotating planar mirror and a concave frusto-conical mirror encircling the planar mirror, which serve for directing the light beam towards the object. The frusto-conical mirror, the planar mirror and a light receiver serve for receiving light beams which are reflected from the object. Electronic circuitry connected to the light receiver serves for calculating the travel time of the beam to and from the object, with a modulator causing the light beam to be modulated with a fixed frequency and the rotating planar mirror and the frusto-conical mirror causing the light beam to sweep across the object at a defined angle/defined angles relative to a fixed plane of reference during the entire sweeping operation.

U.S. Pat. No. 6,068,106 discloses a unit for conveying products and having a main conveying device in the form of a belt conveyor; two secondary conveying deices for feeding respective streams of products to the main conveying device via respective inputs; and a distributing device for so controlling the two streams that the products in a first of the two streams, on reaching an output of the main conveying device, are offset with respect to the products in a second of the two streams, so as to form a single succession of products through the output. The two inputs are separated by a vertical partition extending towards the location where the two streams are combined.

BRIEF SUMMARY OF THE INVENTION

According to a first aspect of the present invention, there is provided a method of automatically inspecting matter for varying composition, comprising advancing a stream of said matter through a detection station, emitting a detection medium to be active at a transverse section of said stream at said detection station, wherein said medium is varied by variations in the composition of said matter at said transverse section, detecting the varied medium at detecting means and generating detection data in dependence upon the variations in said medium, characterised by receiving the varied medium over substantially the width of the stream at receiving means which physically extends across substantially the width of said stream and which transmits the varied medium towards said detecting means, and also characterized in that the varied medium converges upon itself during its travel from said receiving means to said detecting means.

According to a second aspect of the present invention, there is provided apparatus for automatically inspecting matter for varying composition, comprising advancing means for advancing a stream of said matter, a detection station through which said advancing means advances said stream, emitting means serving to emit a detection medium to be active at a transverse section of said stream at said station, detecting means serving to generate detection data in dependence upon the variations in said medium, and data-obtaining means connected to said detecting means and serving to obtain said detection data therefrom, characterised by receiving means at said station arranged to extend physically across substantially the width of said stream and serving to receive detection medium varied by variations in the composition of said matter at said section, and to transmit the varied medium to said detecting means such that the varied medium converges upon itself during its travel from said receiving means to said detecting means.

Owing to these aspects of the present invention, it is possible for the stream to be relatively wide, so that the inspection rate can be increased, and yet the capital cost of the detecting means need not increase in the same proportion.

The detection medium can be electromagnetic radiation, for example IR or visible light to detect variations in constituency or colour, or an electromagnetic field to detect metal portions of the stream, e.g. in sorting of materials. A wide variety of materials may be sorted from each other, but particularly plastics-surfaced objects sorted from other objects. For the present automatic sorting, the objects must be distributed in substantially a single layer.

Preferably, for sorting of objects, the objects are advanced through the detection station on an endless conveyor belt. If the objects to be separated-out are plastics objects which are substantially transparent to the electromagnetic radiation, e.g. IR, then the conveying surface of the belt should be diffusely reflective of the electromagnetic radiation.

For a polymer, two or more detection wavelength bands in the NIR region of 1.5 microns to 1.85 microns can be employed. For a laminate comprised of polyethylene on paperboard, a first wavelength band centred on substantially 1.73 microns is employed, as well as a second wavelength band centred less than 0.1 microns from the first band, for example at about 1.66 microns.

The matter may comprise laminate comprised of a first layer and a second layer underneath said first layer and of a material having a spectrum of reflected substantially invisible electromagnetic radiation significantly different from that of the material of the first layer. As a result, the spectrum of substantially invisible electromagnetic radiation, particularly IR, reflected from such laminate can be readily distinguishably different from the spectrum of the radiation reflected from a single layer of the material of either of its layers.

Using substantially invisible electromagnetic radiation, particularly IR, has the advantage of permitting more effective determination of the composition of the first layer.

In cases where the first layer is a polymer, e.g. polyethylene, for the diffusely reflected IR from the substrate to be sufficient for detection purposes, the first layer should be no more than 1 mm. thick. Its thickness is advantageously less than 100 microns, preferably less than 50 microns, e.g. 20 microns.

If the stream is a continuous strip of laminate advancing on a laminating machine, for example a polymer coating machine coating a polymer layer onto a substrate, it is possible to detect any variation in composition of the advancing polymer layer and to correct the coating process accordingly.

Alternatively, it is possible to separate-out objects, e.g. waste objects, of a predetermined composition from a stream of matter, e.g. waste matter, which can be relatively wide compared with a sequential stream, so that a relatively high rate of separation can be achieved.

According to a third aspect of the invention, there is provided a method of automatically inspecting matter for varying composition, comprising advancing a stream of said matter through a detection station, emitting a detection medium to be active at a transverse section of said stream at said detection station, wherein said medium is varied by variations in the composition of said matter at said transverse section, receiving the varied medium over substantially the width of the stream at receiving means which physically extends across substantially the width of said stream, and generating detection data in dependence upon the variations in said medium, characterised in that said transverse section comprises a multiplicity of individual detection zones distributed across substantially the width of said stream, and the detection data from said individual detection zones is used to construct a two-dimensional simulation of said matter passing through said detection station.

Typically, there could be a transverse row of some 25 to 50 detection points for a stream 1 m. wide. A central detection system can be applied to "serve" all 25 to 50 detection points if there is sufficient IR intensity across the width of the stream from a single or multiple IR source or even if there is an infrared source at each detection point. Optical fibres may lead the reflected IR from the detection points to this central detection system. However, a system of IR reflectors is preferred to optical fibres, since a reflector system is less expensive, allows operation at higher IR intensity levels (since it involves lower IR signal losses) and is less demanding of well-defined focal depths. If the stream moves at some 2.5 m/sec. and the system is capable of 100 to 160 scans across the stream each second, then detections can be made at a spacing of some 2.5 to 1.5 cm along the stream. When each scan is divided into 25 to 50 detection points, detections can be made in a grid of from 1.5×2.0 cm. to 2.5×4.0 cm. The transverse scanning of the moving stream makes it possible to construct a two-dimensional simulation which can be analyzed using image processing. In this way it is possible to detect:

- matter composition, e.g. thickness, and position in the stream
- shape and size of composition variation
- several composition variations substantially simultaneously.

The detection data processing system will determine wanted/unwanted composition at each point.

For thickness measurement of a surface polymer coating of a packaging web comprised of a paperboard substrate and the polymer coating on the substrate, the apparatus scans the moving web and measures the thickness of the polymer coating by monitoring two lines in the IR spectrum. The IR passes through the polymer and is partially absorbed on the way. When past the polymer layer it meets the paperboard substrate, which diffusely reflects the IR. The diffusely reflected IR travels back through the polymer and is again partially absorbed. The diffusely reflected IR leaving the polymer surface passes to a detector which reads the incoming IR. The absorption will be a measure of "absorption length", viz. the thickness of the polymer layer. The two IR lines are chosen so that one is largely absorbed in the polymer and the other not, so functioning as a reference. Both IR lines are chosen to have low absorption in fibre.

The rough fibre surface largely gives diffuse reflection, while the polymer mainly gives direct reflection, which is not measured.

For food quality control, the apparatus measures the quality of foodstuff by monitoring the absorption spectrum in the IR range. Fat content and maturing of fish, and the maturing of meat is today measured by single detectors only capable of single point measurements. Only the low range of the IR spectrum (<1 micron) is currently used, restricting the available information. The present apparatus enables much wider analysis in the IR spectrum, and also enables an almost continuous total quality control.

In separating beverage cartons from a stream of waste, the signals from each of the wavelength bands are combined using signal processing for each detection. The two-dimensional simulation which is built up as the stream passes the detection station can be processed using robust statistical data analysis. For example, a logical rule may be applied where a minimum cluster of positive detections, for instance 3×3, is required before the system recognises a possible beverage carton. In high speed system (e.g., 2.5 m./sec. belt speed) only slight air pulses (an air cushion) are required to alter the carton exit trajectory from the belt sufficiently that they can land in a bin separate from other objects dropping freely. Normally, some 15-30 positive detections are made on a 1 liter carton. The peripheral detection points in the clusters can thus advantageously be disregarded, only initiating the air pulses according to the interior detection points, so securing more lift than tilt.

In slower speed systems (e.g., 0.2-0.5 m/sec belt speed) more positive air ejection pulses may be required to expel the cartons from the remaining stream. This requires air pulses hitting the cartons near their centres of gravity to avoid uncontrolled ejection trajectories.

Although an advantage of arranging the detection of objects from underneath (rather than above) the waste stream is that it gives as uniform a distance from detection point to object as possible, it has disadvantages which more than outweigh that advantage. By irradiating the waste objects on a conveyor belt with radiation from above and by utilising a reflector system to select that portion of the reflected radiation which propagates roughly vertically, the system can be made very focusing insensitive.

According to a fourth aspect of the present invention, there is provided apparatus for automatically inspecting matter for varying composition, comprising advancing means for advancing a stream of said matter, a detection station through which said advancing means advances said stream, emitting means serving to emit a detection medium to be active at a transverse section of said stream at said station, receiving means at said station arranged to extend physically across substantially the width of said stream serving to receive detection medium varied by variations in the composition of said matter at said section, detecting means serving to generate detection data in dependence upon the variations in said medium, and data-obtaining means connected to said detecting means and serving to obtain said detection data therefrom, characterised in that said station is a metal-detection station, said emitting means serves to emit an electromagnetic field, and said receiving means comprises a multiplicity of electromagnetic field sensing devices arranged to be distributed across said stream.

Owing to this aspect of the invention, particularly effective detection of metal is obtainable.

Thus, in addition to or instead of spectral sensing devices, electromagnetic sensing devices may be employed at a metal-detection station. By means of an antenna extending across the advancing means, an alternating electromagnetic field can be set up across the advancing means. By providing as many eddy current detection points (in the form of individual detection coils) across the advancing means as there are spectral detection points a simultaneous metal detection can be performed at very low additional cost.

Thereby, with a waste stream including polymer-coated beverage cartons, and with several air jet arrays arranged one after another it becomes possible to sort out:

beverage cartons without an aluminium barrier beverage cartons with an aluminium barrier other metal-containing objects.

With a more elaborate spectral analysis it also becomes possible to identify and sort out the type of polymer in a plastics object. The system could hence be applied to sorting into separate fractions the various plastics types occurring.

An important cost factor in the spectral analysis system, whether mirror systems or fibre optic systems are used, is the method chosen to "serve" the detection points.

According to a fifth aspect of the present invention, there is provided a method of automatically inspecting matter for varying composition, comprising advancing a stream of said matter through a detection station, irradiating with electromagnetic radiation comprising substantially invisible electromagnetic radiation a section of said stream at said station, scanning said section and determining the intensity of substantially invisible electromagnetic radiation of selected wavelength(s) reflected from portions of said stream, and obtaining detection data from said detection station, characterised in that said scanning is performed in respect of a plurality of discrete detection zones distributed across said stream and in that said determining is performed for each detection zone in respect of a plurality of said wavelengths simultaneously.

Owing to this aspect of the present invention, it is possible to increase the rate of reliable detection.

One device scanning all of the detection points should be the simplest and least expensive. A high-quality, high-speed device is required, but one optical separation unit with the required number of separation filters and detectors can then serve all detection points.

Frequency multiplexing IR pulses to all detection points is another alternative but this system would be more sensitive to interference and more costly than the first alternative.

Time multiplexing, whether of IR pulses to all detection points or of analysis of the diffusely reflected IR, can be somewhat simpler than frequency multiplexing, but implies that spectral identifications in the various wavelengths should be done sequentially, which could pose practical problems and limitations.

Determination that post-consumer beverage cartons contain polyethylene-coated paperboard can advantageously be done with only a few IR wavelengths analysed. Only NIR wavelengths seem to be required to be analysed, for example:

| | Wavelength (microns) | Filter Band Width (nm.) |
|---|---|---|
| 1. | 1.565 | 85 |
| 2. | 1.662 | 34.5 |
| 3. | 1.737 | 32 |
| 4. | 1.855 | 79 |
| 5. | 2.028 | 114 |

Wavelength no. 5, 2.028 microns, is quite moisture-sensitive and may advantageously be omitted. This will leave a very low number of wavelengths to be analysed and compared, thus increasing the maximum computational speed of the system considerably compared to existing systems designed for elaborate polymer absorption characteristic comparison.

According to a sixth aspect of the present invention, there is provided a method of separating polymer-coated paperboard objects from a stream of waste, comprising advancing said stream through a detection station and separating the polymer-coated paperboard objects from the stream, characterised in that at said station a determination is made, using substantially invisible electromagnetic radiation, solely as to whether a portion of said waste is or is not a polymer-coated paperboard object.

Owing to this aspect of the invention, it is possible to minimize the number of radiation wavelengths required to be analyzed.

Of the hereinbefore mentioned group of wavelengths Nos. 1 to 5, at least Nos. 2 and 3 are advantageously employed where IR radiation is utilized for separating-out of polyethylene-coated board, since, of common objects in a waste stream, paper and polymer-coated paperboard are the most difficult to distinguish between with IR detection and those two wavelengths give good discrimination between paper and polymer-coated paper.

According to a seventh aspect of the present invention, there is provided a method of automatically inspecting matter for varying composition, comprising advancing through a detection station a first stream of matter, emitting detection medium to be active at a transverse section of said stream at said detection station, wherein said medium is varied by variations in the composition of said matter at said transverse section, obtaining from said detection station first detection data as to a constituent of said first stream, characterised by advancing a second stream of matter through said detection station simultaneously with said first stream, emitting detection medium to be active at a transverse section of said second stream at said detection station, wherein the latter medium is varied by variations in the composition of matter of said second stream at the latter transverse section, and obtaining from said detection station second detection data as to a constituent of said second stream, and also characterised in that the varied medium from both of the first and second streams is received by a receiving device common to both streams.

According to an eighth aspect of the present invention, there is provided apparatus for automatically inspecting matter for varying composition, comprising a detection station, first advancing means serving to advance through said station a first stream of matter, first emitting means serving to emit detection medium to be active at a transverse section of said stream at said detection station, a receiving device serving to receive detection medium varied by variations in the composition of said matter at said section, detecting means serving to produce first detection data as to a constituent of said first stream at said station, characterised in that second advancing means serves to advance a second stream of matter through said station simultaneously with said first stream, and second emitting means serves to emit detection medium to be active at a transverse section of said second stream at said detection station, in that said receiving device serves also to receive detection medium varied by variations in the composition of the matter at the latter section and is thus common to both of the first and second advancing means, and in that said detecting means serves to produce second detection data as to a constituent of said second stream.

Owing to these aspects of the invention, whereby one-and-the-same detection station is employed for at least two streams simultaneously, the capital and running costs of inspection can be reduced compared with a case where the streams have respective detection stations.

The first and second streams can pass through the detection station in respective opposite directions or in a common direction. In the latter case, the streams can be conveyed on an upper run of an endless belt, with a partition along the upper run to keep the streams apart. The streams can be inspected for respective constituents of differing compositions or of the same composition, in which latter case the second stream can be a separated-out fraction of the first stream, to produce a final separated-out fraction of increased homogeneity.

BRIEF DESCRIPTION OF THE SEVERAL VIEWS OF THE DRAWINGS

In order that the invention may be clearly understood and readily carried into effect, reference will now be made, by way of example, to the accompanying drawings, in which.

DETAILED DESCRIPTION OF PREFERRED EMBODIMENTS OF THE INVENTION

Figure 1:
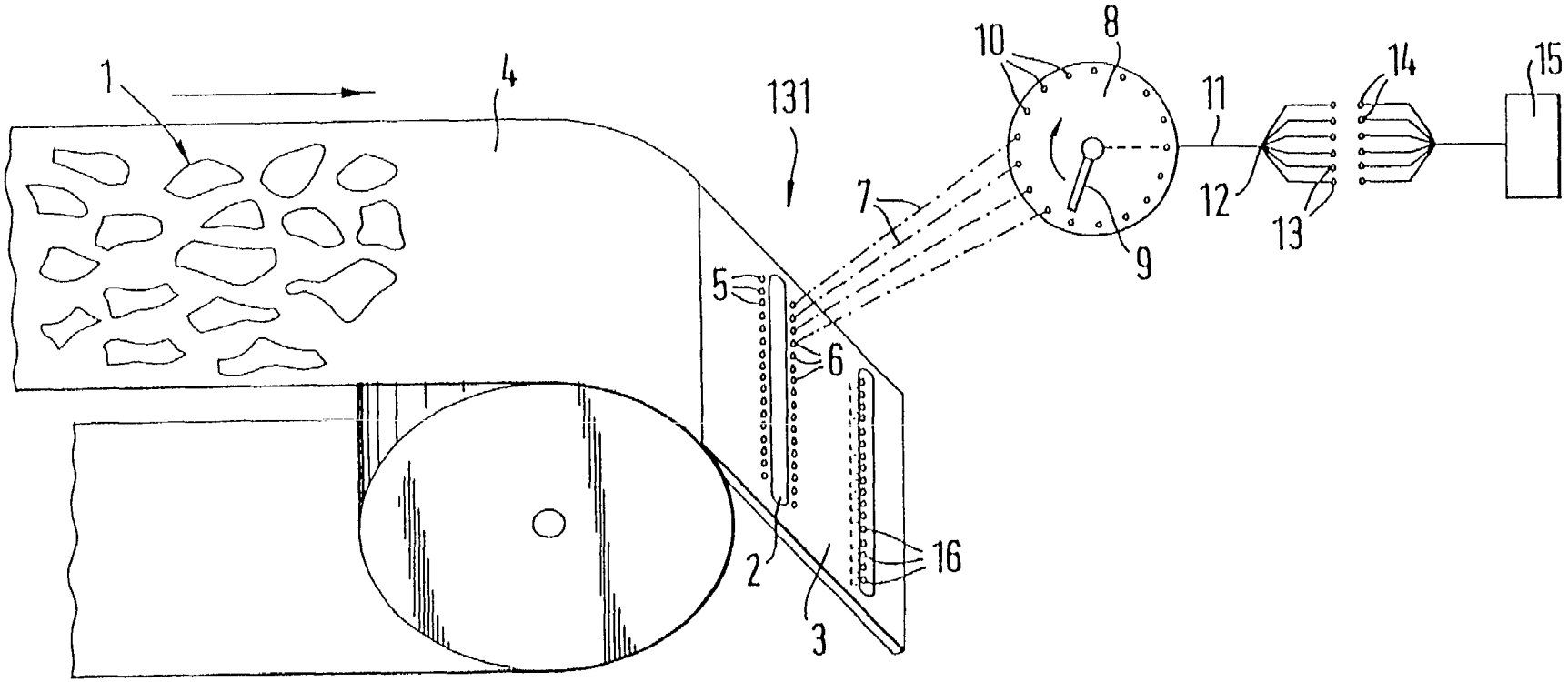
FIG. 1 illustrates diagrammatically a system for automatic sorting of waste objects of differing compositions, with detection from underneath.

Referring to FIG. 1, at a detection station 131 there are 24 detection points across and below a single-layer stream 1 of waste objects as it passes over a transverse slot 2 formed through a downwardly inclined plate 3 at the downstream end of a continuously advancing conveyor belt 4, with a separate IR source 5 for each detection point. At each detection point the reflected IR passes through a lens 6 focussed into an optical fibre 7 and these optical fibres 7 are terminated at a scanner 8, where an arm 9 of a material transparent to IR scans the 24 terminal points 10 of the optical fibres. The plastics arm 9 could be replaced by a mirror system or an IR-conducting fibre. The output 11 of the arm 9 is on the axis of the scanner 8, where a diffuser 12 shines the IR onto 6 infrared filters 13 which pass only respective individual IR wavelengths to IR detectors 14 dedicated to respective wavelengths and connected to an electronic control device 15. In this way each detector 14 serves 24 detection points. The scanning may be performed 100 times per second. If high irradiation intensity is needed, there would be high intensity, IR-producing, halogen lamps 5 at the respective detection points, in which case the focus depth would not be particularly critical. Downstream of the 24 detection points are one or more rows of air jet nozzles 16 to eject laminated objects, for example polymer-coated paperboard cartons, from the stream 1 and controlled by the outputs from the 24 detection points through the device 15. There can additionally be arranged across the stream a row of individual eddy current detectors the signals from which are used to operate one or more further rows of air jet nozzles which are spaced equivalently from the first mentioned row(s) of air jet nozzles as the eddy current detectors are spaced from the spectral detectors and which eject metal objects.

In an alternative form of scanner, the 24 optical fibres terminate at a single fixed disc, mounted opposite to which is a rotating disc carrying 6 (or 12) IR filters passing six wavelengths. Beyond the rotating disc is a ring of 24 detectors. The rotating disc is opaque to IR and the IR passes through that disc only at the locations of the filters. However, since all 6 filters must pass the terminal of one of the optical fibres before a small carton can pass the corresponding detection point, the opaque disc must rotate at a very high speed, at something like 30,000 rpm. Moreover 24 detectors are required compared to the above-mentioned 6.

In an alternative embodiment, a single source of IR illuminates a chopper wheel which effectively emits six streams of IR radiation of a pulsed form, each stream being of a different pulse frequency. These IR streams are then fed by optical fibres to the detection points and the reflections at those detection points are then electrically detected and fed to a single electric processor. However, a disadvantage of this embodiment is that the conversion of the IR into pulsed IR means that the light intensity at the detection points is relatively much reduced and as a consequence the focal depth is relatively critical. It also requires a relatively very fast digital processing system to separate all of the frequencies and produce control outputs where required.

Figure 2:
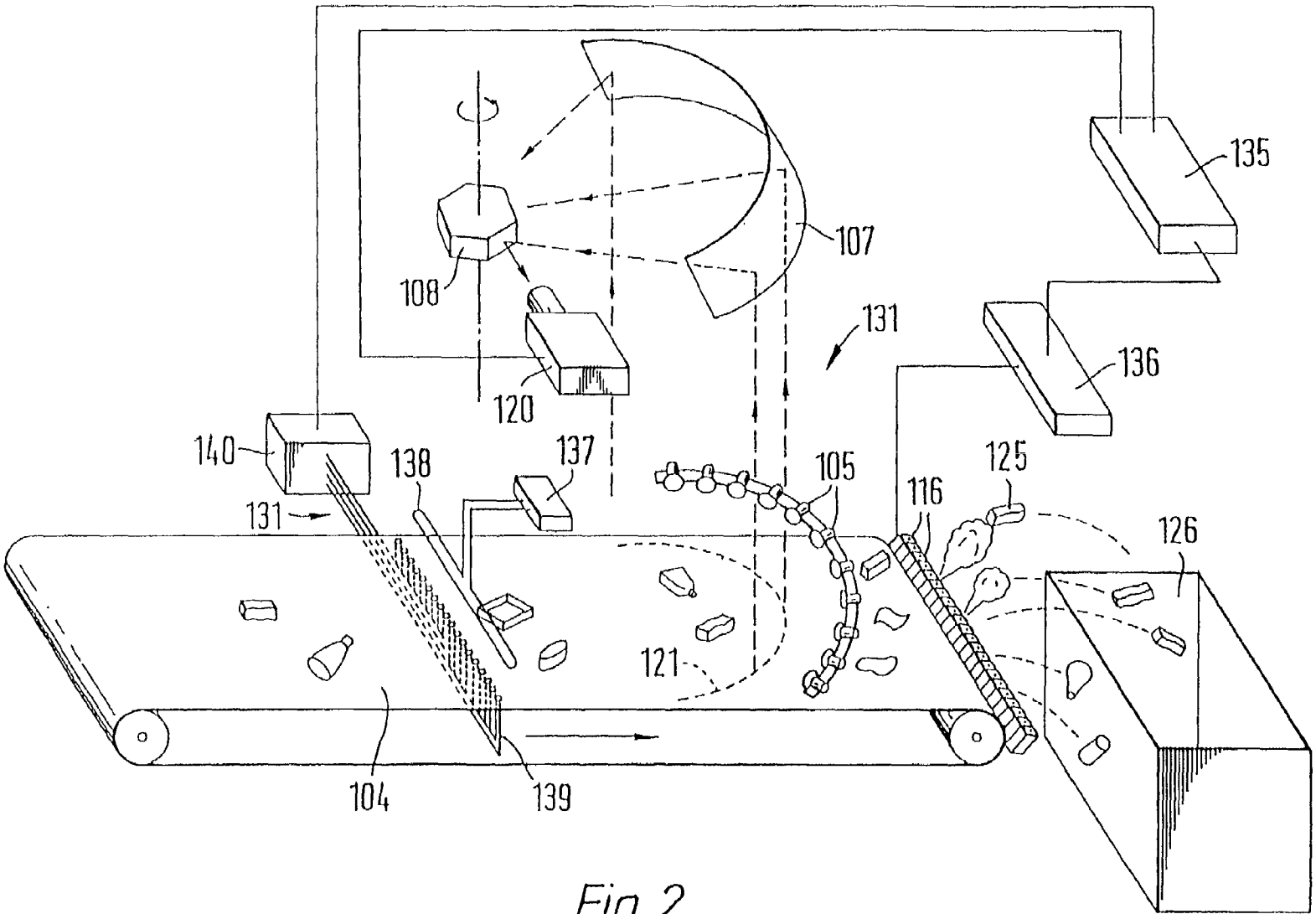
FIG. 2 illustrates diagrammatically a modified version of the system, with detection from above.

Referring to FIG. 2, in this version IR sources 105 are arranged in a horizontal arc across and above the horizontal conveyor belt 4. For some and perhaps all wavelengths in the infrared spectrum to be analysed, it is very desirable to avoid the forwarding towards the IR detectors (referenced 114 in FIG. 4) of directly reflected IR. Diffusely reflected IR shows the best and most clearly defined absorption characteristics, which form the basis for determining the materials and laminate identity of the waste objects. This means that the IR sources 105 are mounted at low angles with respect to the conveyor belt 4 and the object surfaces to be identified, in order to reduce chances for direct IR reflection. It is also expected to be advantageous to mount the light sources 105 in such a way that each detection point is illuminated by more than one of the sources 105, to minimise shadows and to minimise the sensitivity of the system to the orientation of the object surfaces to be inspected.

An IR transmission system 107, 108 is based on metallic mirrors. By using a reflector 107 in the form of roughly a conical segment, with roughly a vertical cone axis, it is possible to select that portion of the reflected IR from the objects on the conveyor belt which propagates in roughly a vertical direction, thereby making the system very focusing insensitive. This is because, if the only IR which is detected is roughly vertical, then variations in the heights of objects does not produce false readings caused by hiding of short objects by tall ones or by misrepresentation of the actual positions of objects. Height variations of the objects of up to 20 cm can be tolerated, provided that the objects are sufficiently well irradiated.

By using a reflector 107 in the form of a doubly-curved surface of the shape of part of a torus an extra focussing effect of the IR reflected from a given detection point towards an optical separation/detection unit 120 can be obtained. This will allow more of the reflected IR from a given detection point to be focussed onto the unit 120 than that which propagates in a strictly vertical direction. Thereby, a significant intensity increase can be obtained compared to use of planar or conical reflectors.

By using a rotating polygonal (in this case hexagonal) mirror 108 in front of the optical separation/detection unit 120, it becomes possible to scan an almost arbitrarily chosen number of detection points per scan. The arbitrary choice is possible because the unit 120 is adjustable to sample at chosen, regular intervals. Six times per revolution of the mirror 108, a scan of the width of the conveyor belt is made. With the reflector 107, the "scan line" 121 on the conveyor belt is a circular arc. With a differently shaped reflector, the scan line can be straight. For example, instead of the reflector 107 of roughly conical segment form, it is possible to use a series of individual planar or doubly-curved mirrors appropriately angled to converge the IR towards the mirror 108. This reduces the data processing capacity required compared with the version shown in the Figure, because the distances from the detection points to the air jets 116 at the end of the belt 104 are then equal to each other. Using a hexagonal mirror reduces the necessary rotational speed of the mirror to one-third of a "front and back" 2-mirror configuration. The reflector system 107,108 has low losses and it is possible to operate at high intensity and signal levels. This makes the material/object identification less susceptible to noise in the form of, for instance, stray light and internally generated noise in the opto-electronic systems.

Figure 4:
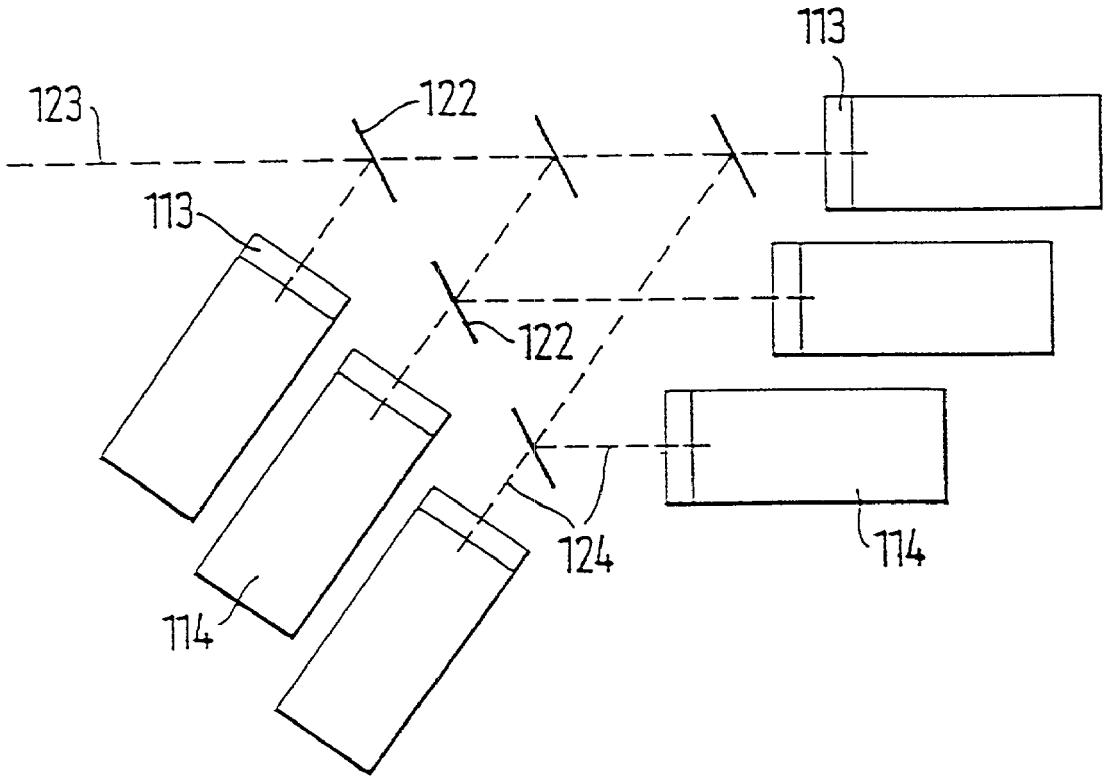
FIG. 4 illustrates diagrammatically a beam-splitting detection unit of the modified version.

As shown in FIG. 4, the unit 120 comprises transparent plates 122 obliquely angled to the reflected IR beam 123 to split it into six beams 124 shown onto "positive" optical filters 113 of the detectors 114.

By applying a beam splitter and optical filter combination for each wavelength to be analysed, all selected wavelengths can be analysed simultaneously referring to the same spot on the object surface.

As an alternative to the beam splitter and filter combination 122 and 113, "negative" optical filters in the form of selectively reflecting surfaces can be employed. Such a negative filter mounted at an oblique angle will transmit nearly all light outside a particular wavelength, and the latter would be reflected to the appropriate detector. All detectors can then operate at much higher signal levels than when a beam splitter and "positive" filters are used.

In slowly operating sorting installations, it is conceivable that the IR wavelengths can be scanned sequentially, so that there is no need to split the reflected IR beam. An error source will occur in that the various wavelengths are not referred to exactly the same spot, but this may be acceptable when the conveyor belt is moving at low speed. By chopping the reflected IR 25 to 50 times per scan by utilising the motion of the polygonal mirror 108, a series of filters can be scanned for each detection location, and by an internal reflector in the optical detection unit all signals can be led to the same detector. This can also be achieved by having the filters mounted in a rotating wheel in front of the detector. The advantage of these solutions is that all detections are made with the same detector, avoiding sensitivity and response differences developing over time in a set of several detectors. Cost savings may also be realised.

Figure 3:
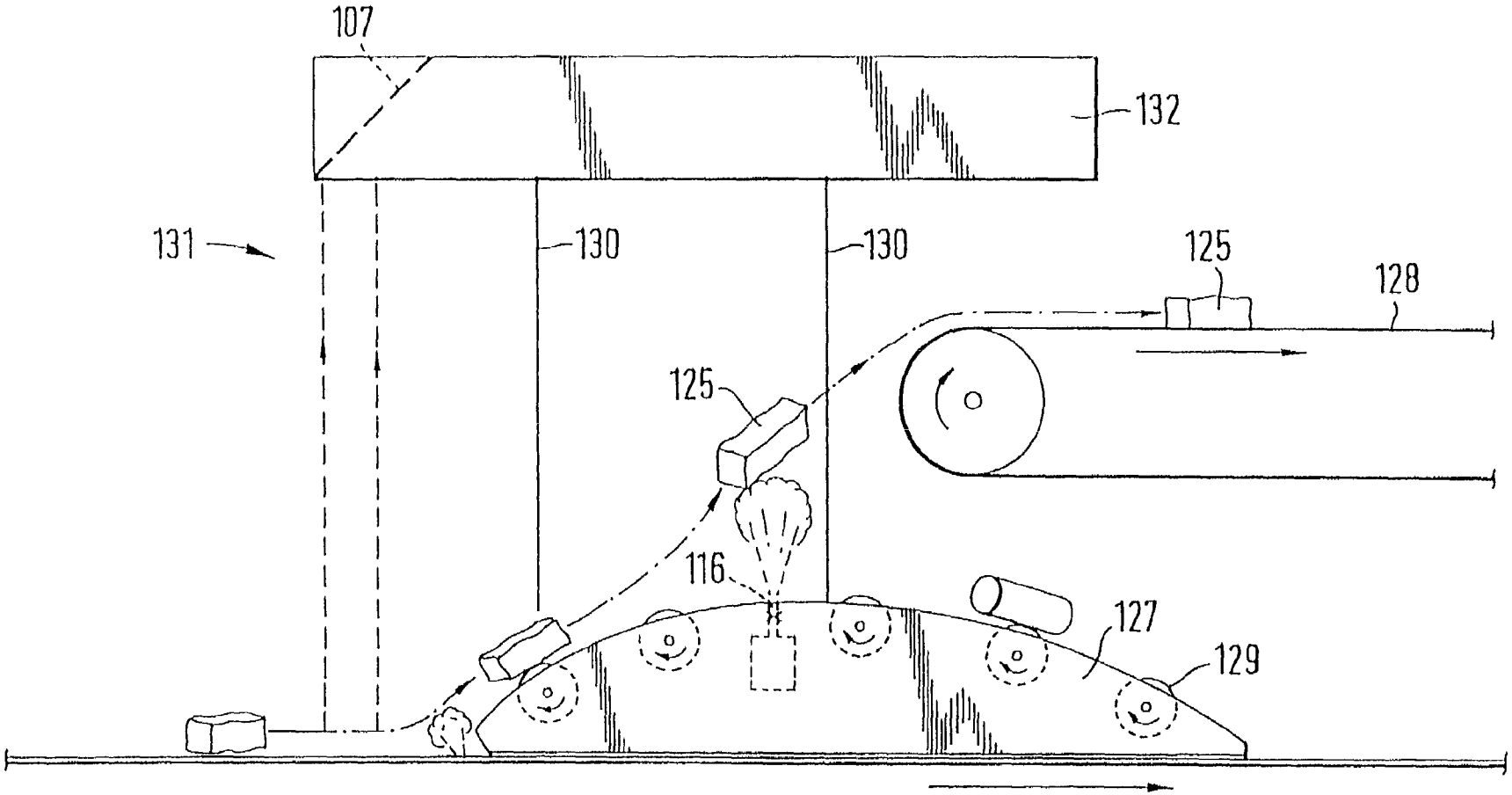
FIG. 3 illustrates diagrammatically a variation of the version of FIG. 2.

The air jet ejection system for the selected waste objects may be a solenoid-operated nozzle array, indicated as 116 in FIG. 2. Normally each nozzle in this array is controlled in dependence upon the signal from an individual detection point, and the ejection is done by changing the elevation angle of the object trajectory when leaving the conveyor belt. For example, FIG. 2 shows polymer-coated cartons 125 being selected for ejection into a bin 126. As an alternative and as shown in FIG. 3, the nozzle array 116 may be mounted inside a slim profile 127 riding on or suspended just above the surface of the belt 104, so that unwanted objects can pass the ejection station without hindrance. Beverage cartons 125 are lifted from the profile and onto a second conveyor 128 by the nozzles 116. Alternatively, once lifted by the nozzles 116, they may be hit with a second air impulse, for example a transverse air flow, which could be triggered by a photocell rather than be continuous, to make them land in a bin at the side of the conveyor belt 104. This "two step" air ejection can also be advantageous when the nozzle array 116 is mounted at the end of the conveyor belt. The profile 127 has some means 129 for conveying the waste objects over its upper surface. Normally, the profile 127 is mounted upon a framework 132 also carrying the detection system 107, 108, 120.

In high-speed conveying systems, the belt 104 may have a speed in excess of 2 m/sec. The objects will then have a sufficient speed in leaving the belt at the end that only a weak air impulse, which might even be an air cushion, is required to change the trajectory. Possibly all detection points can be made to trigger such a weak air impulse allowing a very simple logic for the nozzle control, because there would be no need to calculate the centre of gravity of the object.

The analogue signals from the detector 120 are fed to an analogue-to-digital converter and data processor 135 the output from which is supplied to a controller 136 for solenoid valves (not shown) which control the supply of compressed air to the respective nozzles of the array 116.

Instead of or in addition to the IR-detection arrangement 105, 107, 108, 120, there may be employed, at the same detection station 131 or a second detection station 131, a metal-detection arrangement also illustrated in FIG. 2. The latter arrangement comprises an electrical oscillator 137 supplying an antenna 138 extending across substantially the whole width of the belt 104. The antenna 138 generates an oscillating electromagnetic field through the belt 104 which is detected by a row of a multiplicity of sensing coils 139 extending underneath the upper run of the belt 104 across substantially the whole width of the belt. The electrical outputs from the coils 139 are fed to a coil induction analyser, the output from which is fed to the converter/processor 135 and is utilised in controlling the supplies of compressed air to the nozzles 116.

Figure 5:
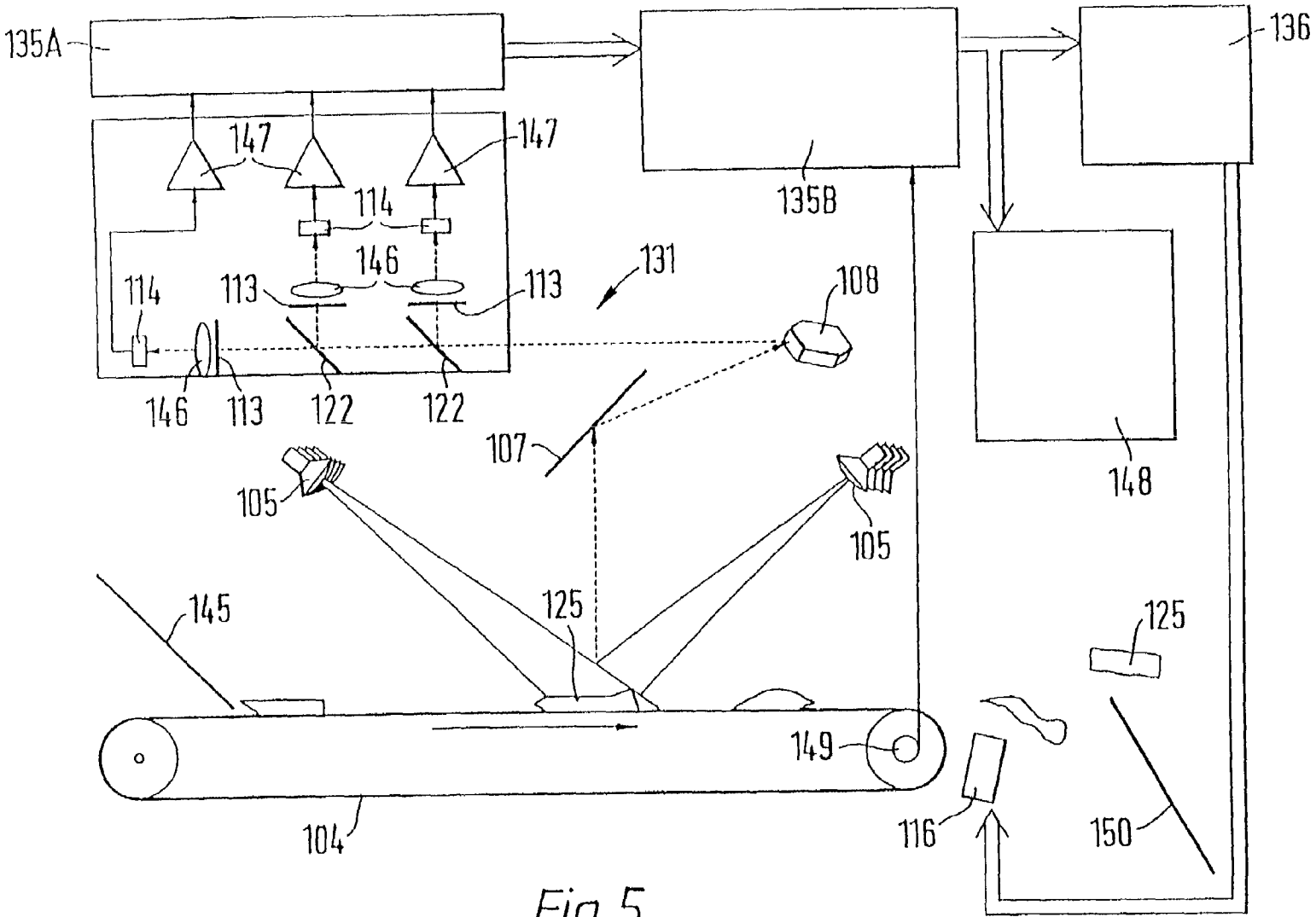
FIG. 5 illustrates diagrammatically another modified version of the system in which detection is performed using three selected wavelengths of diffusely reflected IR.

Referring to FIG. 5, in this preferred version waste objects are fed down a slide 145 (which helps to promote a single layer of waste objects on the conveyor 104) onto the horizontal conveyor 104. Arrays of halogen lamps 105 extend across the belt 104 at respective opposite sides of the detection station and are directed onto that transverse section of the belt at the station and so illuminate objects thereon from both upstream and downstream to reduce shading of objects from the light emitted by the lamp 105. The diffusely reflected light from the objects is reflected by the mirror 107 (or equivalent folding mirrors) onto the polygonal mirror 108, which is rotatable about a vertical axis, and thence to two beam splitters 122. The three sub-beams produced by the two splitters 122 pass to three positive optical filters 113, whence the IR beams of three respective predetermined wavelengths pass through respective lenses 146 to three detectors 114. The detectors 114 are connected via respective amplifiers 147 to an analogue-to-digital converter 135A the output from which is fed to a data processing module 135B. The module 135B is connected to both a user interface 148 in the form of a keyboard/display module and to a driver circuit 136 for solenoid valves of the respective nozzles of the array 116. A tachometer 149 at the output end of the conveyor 104 supplies to the module 135B data as to the speed of the belt 104. The nozzles eject the cartons 125 from the stream to beyond a dividing wall 150.

Figure 6:
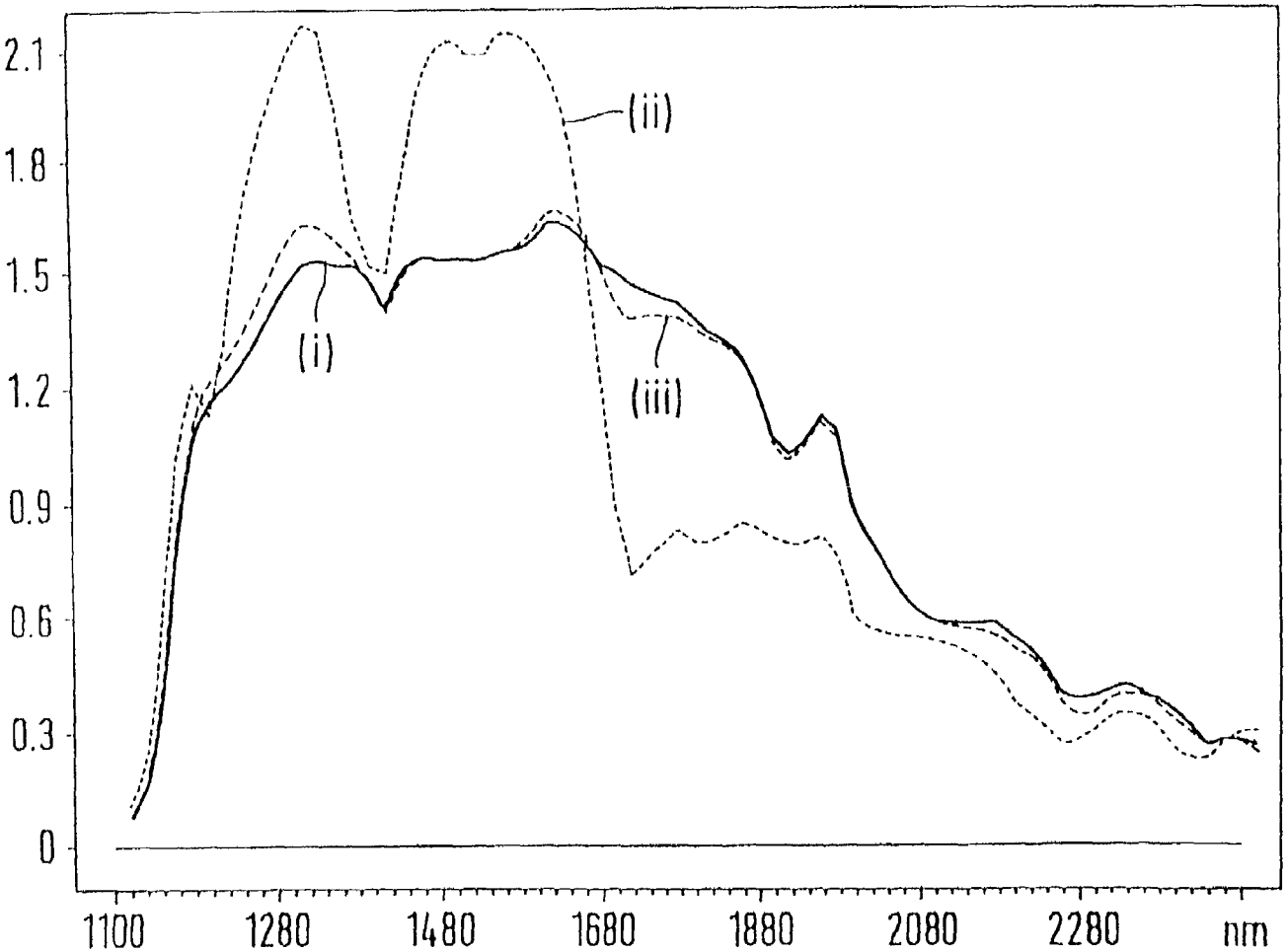
FIG. 6 is a graph of intensity against frequency for diffusely reflected IR and showing respective curves for a single layer of paperboard, a single layer of LDPE (low density polyethylene), and a laminate consisting of LDPE-coated paperboard.
Figure 7:
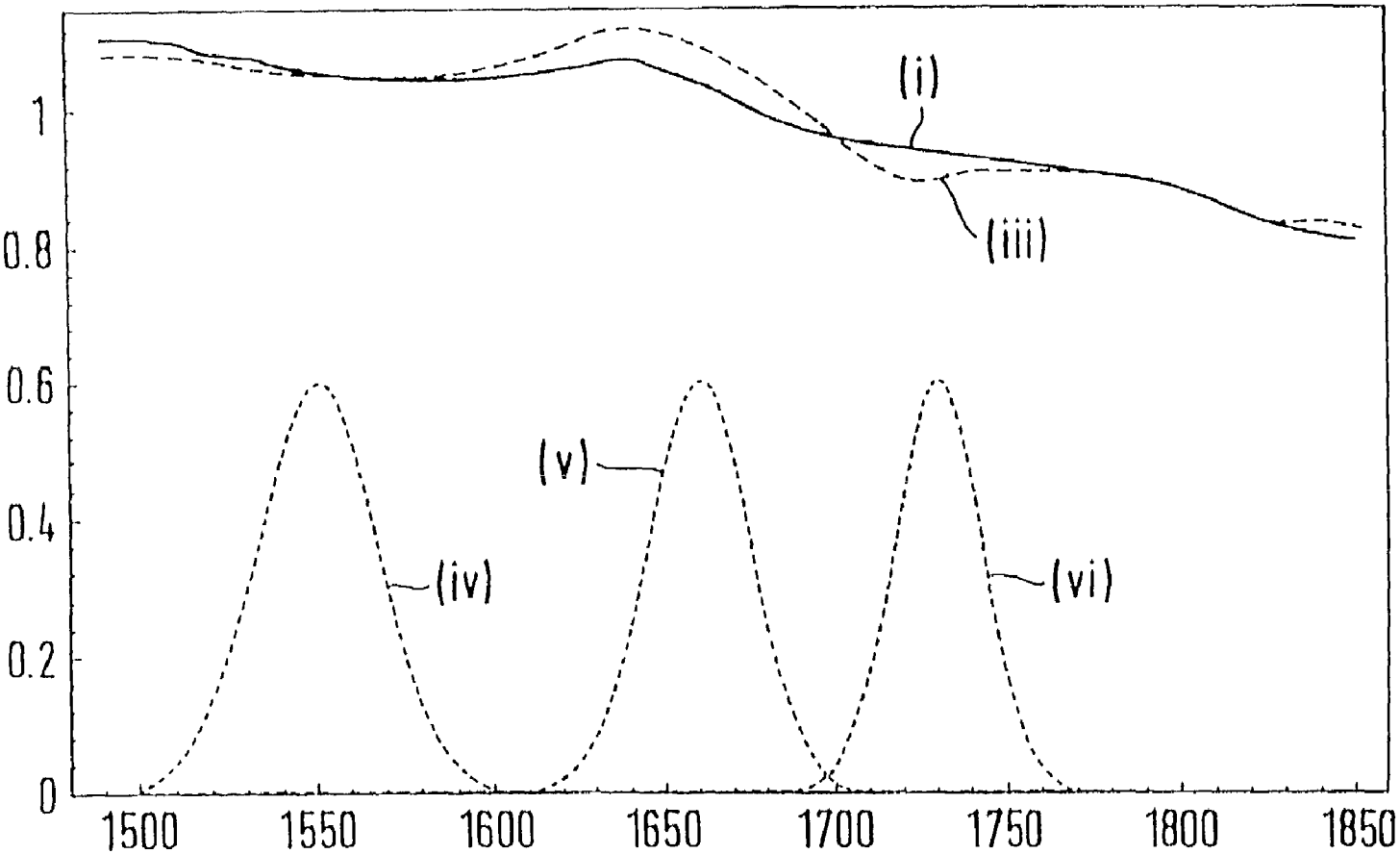
FIG. 7 is a graph similar to FIG. 6 but showing sections of respective curves for the paperboard layer and the laminate and also respective reference transmission curves for three optical filters included in the system of FIG. 5.

FIG. 6 illustrates in full line, dotted line and dashed line, respectively, the curves (i), (ii) and (iii) of typical diffusely reflected IR spectra for paperboard, LDPE, and LDPE-coated paperboard, respectively. In FIG. 7, the three dotted lines (iv) to (vi) show the curves of the transmission bands of the three filters 113 in FIG. 5. Particularly the band (vi) centred on 1730 nm. and, to a lesser degree, the band centred on 1660 nm. are optimisations for segregation between paper and paperboard, on the one hand, and LDPE-coated paperboard, on the other hand. The band (iv) centred on 1550 nm. serves to distinguish LDPE-coated paperboard from certain other materials, e.g. nylon and some plastics with much colour pigment. The curves (i) to (iii) in FIGS. 6 and 7 have been normalised such that the average value of the intensity over the wavelength range is 1.0.

Figure 8:
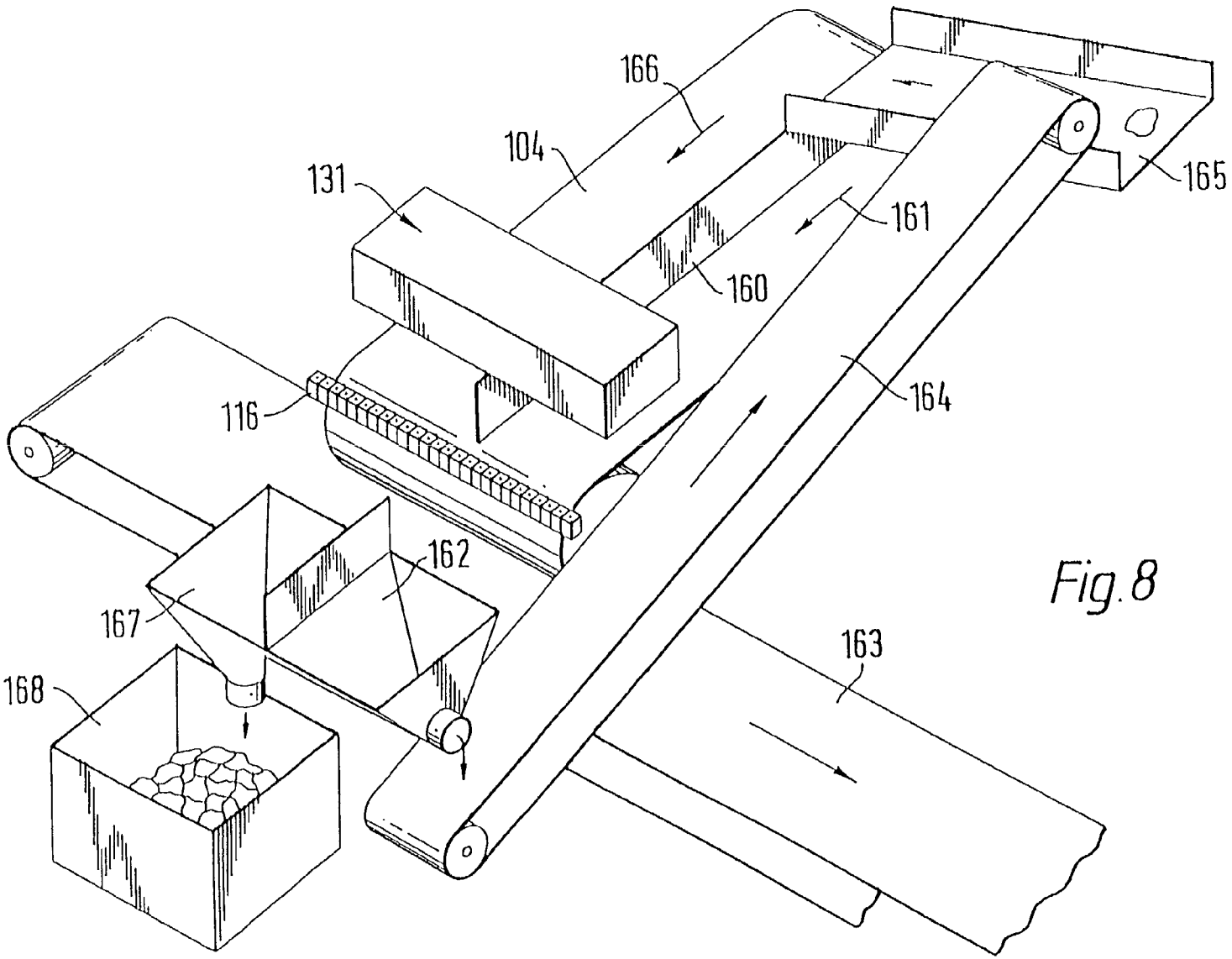
FIG. 8 is a diagrammatic perspective view from above of a further modified version of the system.

Referring to FIG. 8, this version has the horizontal upper run of its belt 104 divided into two lanes by a longitudinal partition 160. The detection station(s) 131 again contain the light-receiving means (7;107) and/or the electromagnetic-field generating means (138) and its associated field-variation detecting means (139) and this/these again extend(s) across substantially the whole width of the belt 104. The nozzle array 116 again extends across substantially the whole width of the belt 104. A stream of waste including objects, for example laminate cartons, to be separated-out is advanced, as a single layer of waste, along the lane indicated by the arrow 161, the objects to be separated-out are detected in any manner hereinbefore described with reference to the drawings, and are ejected into a hopper 162 with the aid of air jets from nozzles of the array 116, most of the remaining waste falling onto a transverse conveyor belt 163 for disposal. The stream fraction discharged into the hopper 163 tends to contain a proportion of waste additional to the objects to be separated-out and is therefore discharged from the hopper 162 onto an upwardly inclined, return conveyor belt 164 which lifts the fraction onto a slide 165 whereby the fraction slips down onto the lane indicated by the arrow 166. The belt 104 then advances the fraction along the lane 166 past the detection station(s) 131, while it simultaneously advances the stream along the lane 161 past the same detection station(s), and subsequently the objects to be separated-out are ejected from the fraction with the aid of air jets from other nozzles of the array 116 into a hopper 167 whence they are discharged into a bin 168. Other waste from the fraction falls onto the conveyor 163 for disposal.

Figure 9:
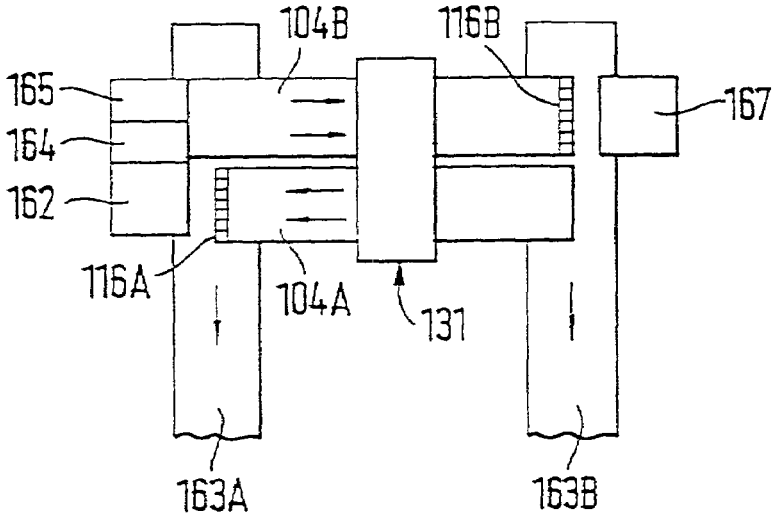
FIG. 9 is a diagrammatic top plan view of a yet further modified version of the system.

FIG. 9 shows a modification of FIG. 8, in which two parallel, horizontal conveyor belts 104A and 104B disposed side-by-side advance in respective opposite directions through a detection station or stations 131, the light-receiving mirror(s) and/or the antenna and the row of sensing coils of which extend(s) across substantially the whole overall width of the two belts 104A and 104B. A stream of waste containing the waste objects to be separated-out is advanced by the conveyor 104A past the detection station(s) 131 where those objects are detected, to an air nozzle array 116A whereby a stream fraction consisting mainly of the objects to be separated-out is ejected into a hopper 162, discharged onto a conveyor 164 and lifted onto a slide 165, whence the fraction slips down onto the belt 104B. The remainder of the stream falls onto a transverse conveyor 163A. The belt 104B advances the fraction past the detection station(s) 131, where those objects are again detected, to an air nozzle array 116B with the aid of which the desired objects are ejected into the hopper 167, remaining waste in the fraction falling onto a transverse conveyor 163B.

The two lanes 161 and 166 or the two conveyors 104A and 104B could advance respective streams from which respective differing types of material (for example laminated material and purely plastics material, or, as another example, laminated material and wood-fibre material or metallic material) are to be separated-out. In that case, the conveyor 164 would be omitted, the hopper 162 would discharge into a bin a stream fraction comprised of the material separated-out into the hopper 162 and the remainder of the stream advanced by the lane 161 or conveyor 104A would be forwarded by the conveyor 163A to the slide 165 to constitute the stream on the lane 166 or conveyor 104B, and the hopper 167 would discharge into a bin a second stream fraction comprised of the other material to be separated-out.

The various embodiments utilising detection by radiation and described with reference to FIGS. 1 to 5, 8 and 9 are applicable in the waste recovery field also to sorting of a mixture of plastics wastes in fractions each predominantly of one type of plastics, and also applicable to a variety of other fields in which matter of varying composition is to be sorted. For example, they are applicable in the food industry for separating-out from animal solids, namely meat and fish, discrete portions, for example whole chickens or salmon or pieces of chicken, salmon, or beef, which are below quality thresholds. As instances, detection of diffusely reflected IR can be used to monitor for excessive amounts of fat, whilst detection of diffusely reflected visible light can be used to determine the colour of the portions and so monitor for staleness, for example. Because a plurality of discrete portions can advance side-by-side in the stream, high capacity monitoring can be achieved, with or without the use of air jets to eject the relevant fraction from the stream.

Figure 10:
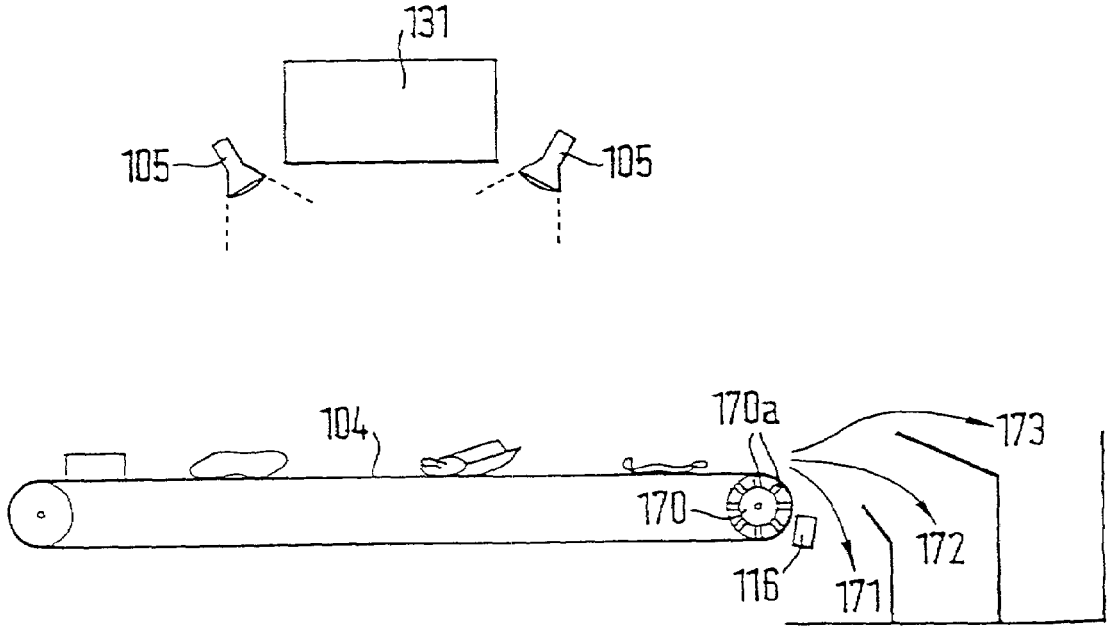
FIG. 10 is a diagrammatic side elevation of a still further modified version of the system.

Referring to FIG. 10, this version includes an eddy current ejection system for ejecting electrically conductive metal from a stream of waste and known per se. The eddy current system has, within a discharge end roller 170 of the belt conveyor 104, permanent magnets 170*a* contained within and distributed along the roller 170 and counter-rotating relative to the roller 170. To separate-out polymer-coated paperboard cartons without metal foil and to improve the separation-out of polymer-coated paperboard cartons with metal foil, the IR detection system of FIG. 5 is also provided, as diagrammatically indicated in FIG. 10, where the IR detection station 131, the two arrays of halogen lamps 105 and the air nozzle array 116 are shown. The belt 104 advances at relatively high speed, at least 2 m./sec. At its discharge end are three compartments 171 to 173, respectively for remaining waste, separated-out metallic objects with greater metal contents and separated-out polymer-coated paperboard objects, usually cartons, whether or not containing metal foil. The metallic objects with greater metal contents, for example post-consumer beer cans, are nudged upwards out of the waste stream by the eddy current system, but, because they are generally heavier than the other objects, fall into the compartment 172 just beyond the general waste compartment 171. The polymer-coated paperboard objects, provided that a surface polymer coating directly onto the paperboard (and not, for example, a surface polymer coating directly onto aluminium foil) faces towards the mirror 107, are nudged upwards by the weak air jet pulses from the nozzle array 116, but to higher than the metallic objects with greater metal contents, and fall into the furthest compartment 173.

Advantages of this version are that it separates waste into three fractions in a single-stage operation and that an IR detection system can be fitted to an already installed eddy current ejection system, without any need to alter either system significantly.

Figure 11:
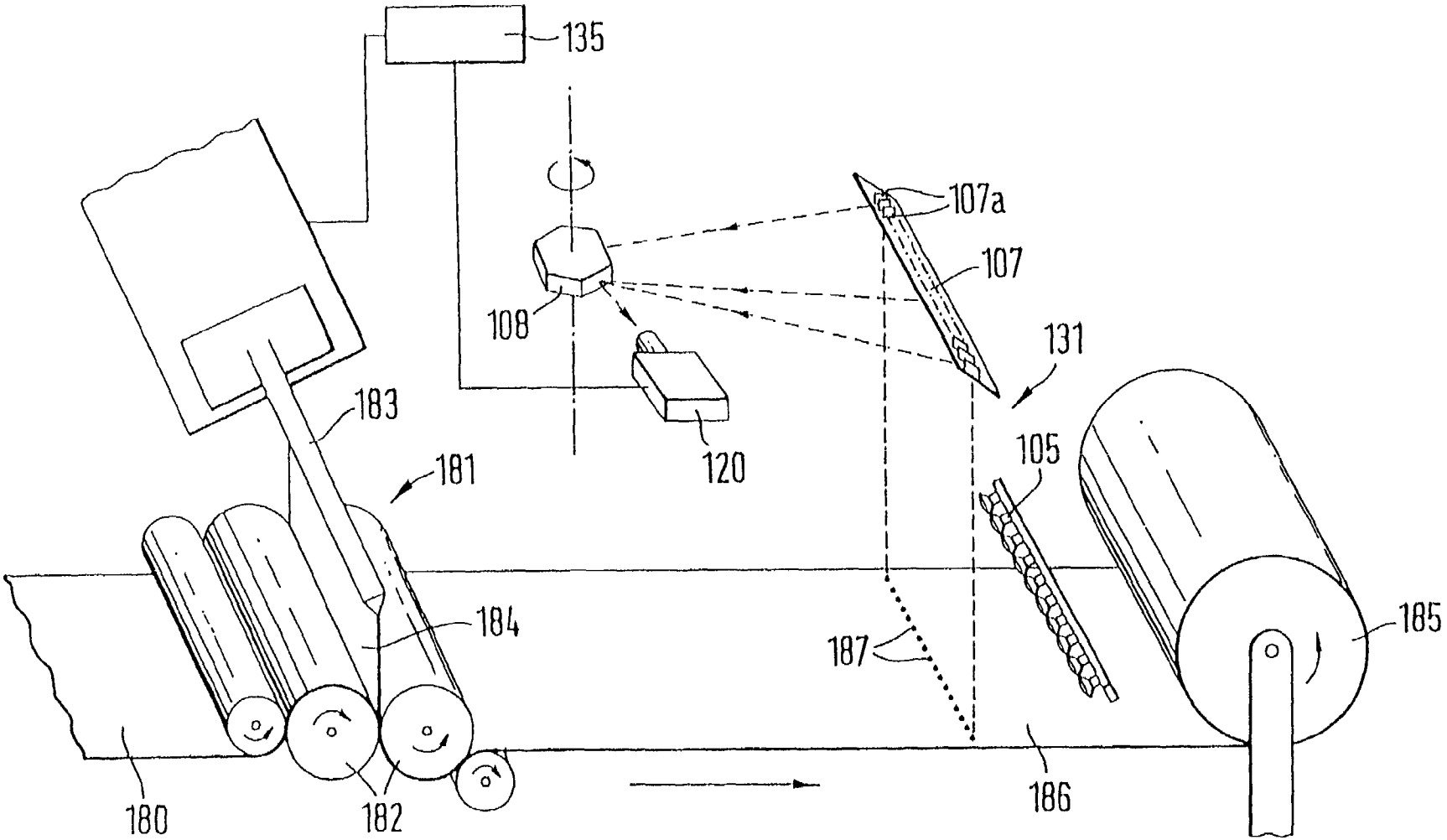
FIG. 11 is a view similar to FIG. 2, but of a system for monitoring and controlling the thickness of a polymer coating applied in a laminating machine.

Referring to FIG. 11, in the laminating machine, a paperboard substrate 180 is advanced through an extrusion coating station 181 and is introduced into the nip between a pair of rollers 182. An extruder 183 extrudes a molten film 184 of polymer, for example LDPE, onto the upper surface of the substrate 180 at the nip. A winding roll 185 advances past the detection station 131 the laminate web 186 so formed. As already explained hereinbefore, to measure the thickness of the polymer coating, two appropriately chosen wavelengths in the IR spectrum are monitored. This monitoring is performed in the converter/processor 135, which controls the extruder 183 accordingly. Instead of being of a part-toroidal form, the mirror 107 can comprise a series of facets 107*a* (or even a series or very small mirrors) arranged in a horizontal row transverse to the laminate 186 and arranged to reflect the diffusely reflected IR from the respective detection points (imaginarily indicated at 187) to the polygonal mirror 108. Each detection point 187 thus has an individual facet 107*a* dedicated to it. In this way, the mirror 107 can extend rectilinearly, rather than arcuately, across the web 186, as can the array of halogen lamps 105, with the advantage of reducing the necessary overall dimension of the detection station 131 longitudinally of the web 186. Such rectilinearly extending mirror 107 is of course applicable in the versions of FIGS. 2 to 5 and 8 to 10, with corresponding advantage.

The invention claimed is:

1. A method of automatically inspecting matter for varying composition, comprising advancing a stream of said matter through a detection station, irradiating with electromagnetic radiation a section of said stream at said station, scanning said section and determining the intensity of electromagnetic radiation of selected wavelength(s) received from portions of said stream, and obtaining detection data from said detection station, wherein said scanning is performed in respect of a plurality of discrete detection zones distributed across said stream and said determining is performed for each detection zone in respect of a plurality of said wavelengths simultaneously.

2. A method according to claim 1, wherein portions of said stream comprise polymer and said plurality of wavelengths comprise a plurality of wavelength bands in the region 1.5 microns to 1.85 microns.

3. A method of automatically inspecting matter for varying composition, comprising passing through a detection station a first stream of matter, emitting detection medium to be active at a transverse section of said stream at said detection station, wherein said medium is varied by variations in the composition of said matter at said transverse section, obtaining from said detection station first detection data as to a constituent of said first stream, passing a second stream of matter through said detection station simultaneously with said first stream, emitting detection medium to be active at a transverse section of said second stream at said detection station, wherein the latter medium is varied by variations in the composition of matter of said second stream at the latter transverse section, and obtaining from said detection station second detection data as to a constituent of said second stream, and wherein the varied medium from both of the first and second streams is received by a receiving device common to both streams.

4. A method according to claim 3, wherein each of the first and second streams at its said transverse section comprises objects distributed across the stream.

5. A method according to claim 3, and further comprising utilising the first and second detection data to separate from the respective first and second streams respective first and second fractions comprised of said constituent of said first stream and said constituent of said second stream, respectively.

6. A method according to claim 5, wherein the first fraction constitutes the second stream.

7. A method according to claim 3, wherein said constituent of said first stream is of substantially the same composition as said constituent of said second stream.

8. A method according to claim 3, wherein said constituent of said first stream is of significantly different composition from said constituent of said second stream.

9. A method according to claim 3 or 4, wherein the first and second streams are advanced in a common direction through said detection station.

10. A method according to claim 3 or 4, wherein the first and second streams are advanced in respective opposite directions through said detection station.

11. Apparatus for automatically inspecting matter for varying composition, comprising a detection station through which first and second streams of matter pass simultaneously with each other, first and second emitting means serving to emit detection medium to be active at respective transverse sections of said first and second streams at said detection station, a receiving device serving to receive detection medium varied by variations in the composition of said matter at said sections and thus being common to both of the first and second streams, and detecting means arranged to be in communication with said receiving device and serving to produce first detection data and second detection data as to respective constituents of said first and second streams at said station.

12. Apparatus according to claim 11 and further comprising first and second advancing means to advance through said station the respective first and second streams.

13. Apparatus according to claim 12, wherein the first and second advancing means take the form of a single conveyor.

14. Apparatus according to claim 13, wherein said single conveyor includes a single conveying belt.

15. Apparatus according to claim 13, wherein said single conveyor has a partition extending therealong to keep the streams apart from each other.

16. Apparatus according to claim 12, and further comprising returning means serving to transport to said second advancing means upstream of said station to constitute said second stream a separated-out fraction of said first stream comprised of said constituent of said first stream.

17. Apparatus according to claim 11, wherein the first and second emitting means are so arranged as to extend across both of the first and second streams.

18. Apparatus according to claim 17, wherein the first and second emitting means comprise a row of radiation sources.

19. Apparatus according to claim 11, wherein said receiving device is so arranged as to extend across both of the first and second streams.

20. Apparatus according to claim 19, wherein said receiving device comprises a radiation-reflecting device.

21. Apparatus according to claim 20, wherein said reflecting device comprises a mirror which is substantially arcuate concavely in a plane parallel to a widthwise plane of the first and second streams and which is obliquely inclined to the former plane.

22. Apparatus according to claim 21, wherein said mirror is part of an imaginary, substantially toroidal surface.

23. Apparatus according to claim 11, wherein said receiving device comprises a multiplicity of metal-sensing means arranged so as to be discretely distributed across the first and second streams and serving to detect metal portions constituting the constituent(s) of at least one of the first and second streams.

24. Apparatus for automatically inspecting a stream of matter for varying composition, comprising a detection station through which said stream passes, emitting means serving to emit a detection medium to be active at a transverse section of said stream at said station, receiving means at said station arranged to extend physically across substantially the width of said stream serving to receive detection medium varied by variations in the composition of said matter at said section, detecting means arranged to be in communication with said receiving means and serving to generate detection data in dependence upon the variations in said medium, and data-obtaining means connected to said detecting means and serving to obtain said detection data therefrom, wherein said station is a metal-detection station, said emitting means serves to emit electromagnetic field and is connected to an oscillator, whereby said electromagnetic field oscillates, and said receiving means comprises a multiplicity of electromagnetic field frequency sensing devices arranged to be distributed across said stream.

25. Apparatus according to claim 24, wherein said emitting means which serves to generate an electromagnetic field comprises an antenna extending across said stream at said metal-detection station.

26. Apparatus according to claim 24, and further comprising advancing means for advancing said stream through said station said advancing means being situated between said emitting means and said receiving means for the field.

27. Apparatus according to claim 24, wherein said data-obtaining means serves to construct from the detection data from said electromagnetic field sensing devices a two-dimensional simulation of said matter passing through said detection station.

* * * * *

UNITED STATES PATENT AND TRADEMARK OFFICE

CERTIFICATE OF CORRECTION

PATENT NO. : 7,262,380 B1
APPLICATION NO. : 09/541718
DATED : August 28, 2007
INVENTOR(S) : Borre Bengt Ulrichsen et al.

It is certified that error appears in the above-identified patent and that said Letters Patent is hereby corrected as shown below:

Column 18, Line 44, claim 12, please insert --serving-- after “mean” and before “to”

Signed and Sealed this

Fourth Day of December, 2007

JON W. DUDAS
*Director of the United States Patent and Trademark Office*